US006390430B1

(12) United States Patent
Hawley et al.

(10) Patent No.: US 6,390,430 B1
(45) Date of Patent: May 21, 2002

(54) PAINT BRUSH HOLDER HAVING FLEXIBLE GRIPPING FINGERS

(76) Inventors: Thomas Hawley, 7497 Arbors Blvd., West Bloomfield, MI (US) 48322; Arthur L. Smith, 3505 Victory Ave., Toledo, OH (US) 43607

( * ) Notice: Subject to any disclaimer, the term of this patent is extended or adjusted under 35 U.S.C. 154(b) by 0 days.

(21) Appl. No.: 09/396,585

(22) Filed: Sep. 15, 1999

(51) Int. Cl.[7] ..... B65D 81/00; B65D 75/14

(52) U.S. Cl. ..... 248/311.2; 206/362.1; 206/15.2; 206/362.4

(58) Field of Search ..... 248/311.2; 206/361, 206/362, 362.1, 362.2, 362.3, 362.4, 15.2, 15.3; 15/146

(56) References Cited

U.S. PATENT DOCUMENTS 248,489 A * 10/1881 Miles ..... 15/38
1,612,887 A * 1/1927 Saunders ..... 206/361
1,851,521 A * 3/1932 Olsen ..... 206/361
3,393,412 A * 7/1968 Wrbican ..... 206/361 X
3,623,179 A * 11/1971 Roth ..... 15/104.001
4,467,533 A * 8/1984 Sica ..... 34/58
4,771,501 A * 9/1988 Leiter ..... 206/361 X
4,802,576 A * 2/1989 Kern ..... 206/361 X
4,847,939 A * 7/1989 Derencsenyi et al. ... 206/361 X
5,178,274 A * 1/1993 Long ..... 206/361
5,191,973 A * 3/1993 Shteynberg ..... 206/15.2
5,244,090 A * 9/1993 Keith ..... 206/361
5,540,363 A * 7/1996 Wilson ..... 206/361 X
5,645,167 A * 7/1997 Conrad ..... 206/361

* cited by examiner

*Primary Examiner*—Gregory J. Strimbu
(74) *Attorney, Agent, or Firm*—Brinks Hofer Gilson & Lione

(57) ABSTRACT

A brush holder for engaging the body of a paint brush, keeping the bristles of the paint brush from being distorted while immersed in a container of paint or solvent. The paint brush holder includes a hollow, elongated, generally rectangular shell with projections for engaging and holding the paint brush disposed in the interior of the shell. The projections are inwardly directed, flexible, stepped and disposed in rows. The handle of the paint brush may be inserted in one end of the holder and pushed into the projections or the holder may be opened to accommodate insertion.

13 Claims, 3 Drawing Sheets

PAINT BRUSH HOLDER HAVING FLEXIBLE GRIPPING FINGERS

BACKGROUND OF THE INVENTION

1. Field of the Invention

This invention relates to holding devices for brushes and specifically to a device for suspending a paint brush so that it may be immersed in a container of paint or solvent without allowing the bristles of the brush to contact the container.

2. Description of the Related Art

Many times when using a brush for painting, it is necessary to interrupt the process before it is finished. If no means exists for keeping the paint from curing while the brush is not being used, the brush must be cleaned prior to every interruption. If the brush was not cleaned, or if the paint on the brush was not prevented from curing or drying out, the brush could be ruined before it is used again. Keeping the paint on the brush from curing can be done in a variety of ways. One method frequently used is to place the brush in the container of paint being applied. As long as the bristles of the brush are immersed in paint, the brush will not dry out and the bristles will remain flexible and capable of holding paint. Unfortunately, this solution causes the bristles of the brush to support the weight of the brush, and thereby become deformed. Furthermore, if the paint container is substantially full, a significant portion of the brush handle may become covered with paint, creating another problem.

Alternatively, the brush can be laid on its side, but then the handle becomes immersed in the liquid. If the brush is left in the container with the weight supported by the bristles for a lengthy period of time, the brush may become so deformed as to lose its resiliency and become useless.

The present invention solves this problem by providing a structure that a brush may be easily inserted into and removed and that allows the liquid the brush is immersed in, to be in contact with the brush, preventing it from drying out. Using the present invention, the painting process can be interrupted without cleaning the brush and without risking deformation of the bristles.

SUMMARY OF THE INVENTION

The present invention comprehends a brush holder for engaging the body of a paint brush, keeping the bristles of a paint brush from contacting any rigid surface and thereby being distorted while immersed in a container of paint or solvent. The brush holder consists of a hollow, elongated, generally rectangular shell with projections for engaging and holding a brush disposed in the interior of the shell. The projections include rows of flexible, inwardly directed stepped projections. The handle of the brush may be inserted in one end of the holder and pushed into the projections or the holder may be opened to accommodate insertion.

The paint brush holder surrounds the bristles of the paint brush and is open to the liquid in the container. The paint brush holder supports the brush by engaging the handle or the body of the brush without touching the bristles. The bristles of the brush extend downward through the interior of the paint brush holder, being held in such a manner as to minimize or completely eliminate contact of the bristles of the brush with the holder. The interior cavity of the paint brush holder is of sufficient length so that when gripping the paint brush by the handle or the body, the bristles are completely surrounded and protected from contact with the container. The paint brush holder rests upon the bottom of the container or against the side, and prevents the bristles both from contacting the container and from supporting any of the weight of the brush or holder. The bristles are thereby prevented from being distorted by the weight of the brush. Loss of effectiveness and damage of the brush is thereby prevented.

Thus it is an object of the present invention to provide a paint brush holder which suspends a paint brush within a container of liquid which inhibits contact of the paint brush bristles from the bottom of a container.

It is a further object of the present invention to provide a paint brush holder for suspending a paint brush in paint, solvent, cleaning fluid or other liquid.

Further objects and advantages of the present invention will become apparent by reference to the following description of the preferred and alternate embodiments and appended drawings wherein like reference numbers refer to the same component, element or feature.

DESCRIPTION OF THE PREFERRED AND ALTERNATE EMBODIMENTS

Figure 1:
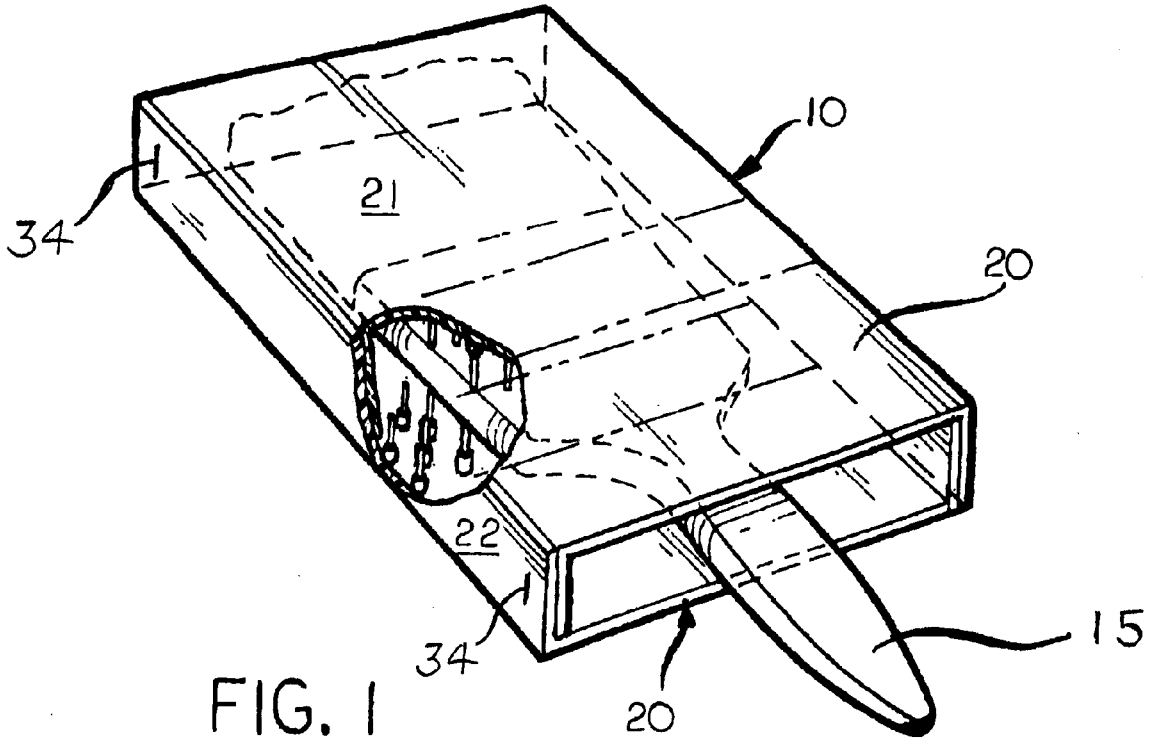
FIG. 1 is a perspective view with a portion broken away of a brush holder according to the present invention with a brush disposed therein.

Referring to FIG. 1, a paint brush holder is illustrated and generally designated by the reference number 10. The brush holder 10 is illustrated with a typical paint brush 15 disposed therein. The brush holder 10 is preferably formed from two casing halves 20.

Figure 3:
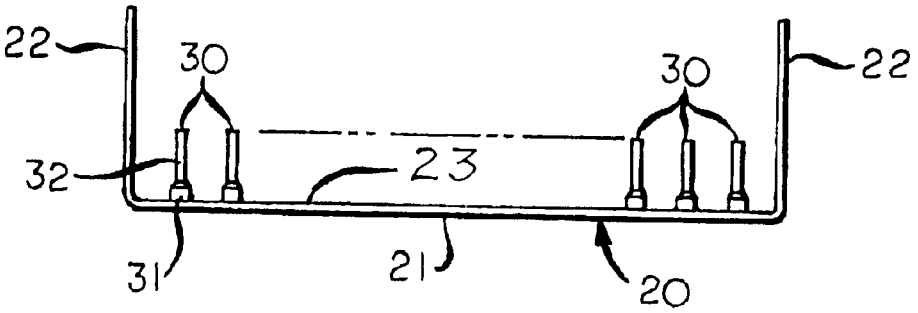
FIG. 3 is an end elevational view of one half of a brush holder according to the present invention.
Figure 2:
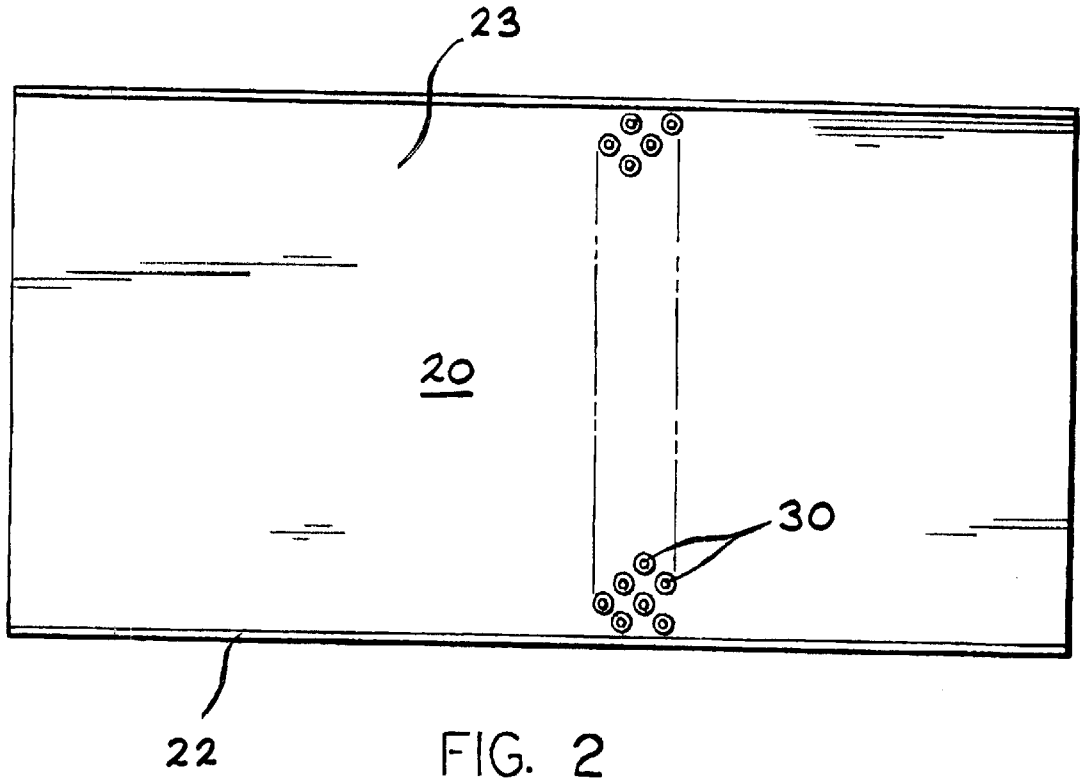
FIG. 2 is a plan view of one half of a brush holder according to the present invention.
Figure 4:
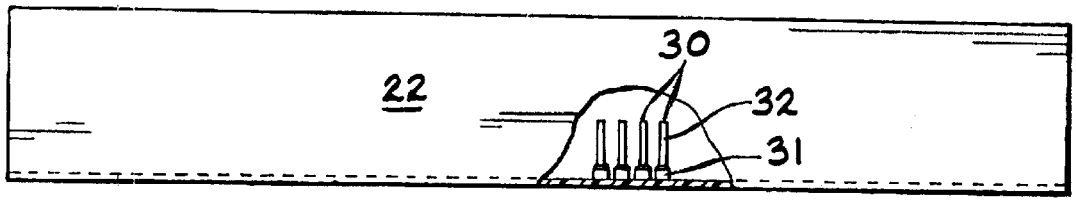
FIG. 4 is a side elevational view with a portion broken away of one half of a brush holder according to the present invention illustrating a plurality of projections.

Referring to FIGS. 2, 3 and 4, the construction of the casing halves 20 may be seen. In a first embodiment, the brush holder 10 is formed from identical casing halves 20. The following description relates to only one casing half 20 and uses the singular when reference to the casing half 20 is made, it being understood that the other casing half 20 is identical in all respects and symmetrically disposed when assembled to form the brush holder 10.

Brushes come in a variety of cross sections, including round, elliptical, square, and rectangular. This disclosure is not meant to limit the invention to any particular shape or brush, rather it is envisioned that the brush holder 10 made be constructed to define any necessary cross sectional shape to accommodate any brush. For purposes of convenience, only an embodiment of the brush holder 10 suited to hold brushes of rectangular cross section, such as the brush 15, will be fully disclosed, as the principles involved are the same regardless of the final shape.

The casing half 20 generally includes a planar wall 21 having two perpendicular, spaced-apart lips or sidewalls 22 extending in the same direction from the edges of the planar wall 21 and flanking an inside surface 23. In the preferred embodiment shown in FIGS. 2, 3 and 4, the planar wall 21 is generally rectangular with the sidewalls 22 extending from the two long edges of the rectangular planar wall 21.

A plurality of flexible projections or fingers 30 are preferably disposed on the inside surface 23 of the planar wall 21 and extend therefrom in generally the same direction as the sidewalls 22. The projections or fingers 30 are on the interior of the brush holder 10 when it is fully assembled. The exact placement of the fingers 30 on the inside surface 23 is dependent upon the shape of the brush desired to be held, but in general the fingers 30 will be disposed nearer one end of the planar surface 21 to ensure that the fingers 30 grip the body of a paint brush when inserted into the brush holder 10, rather than gripping the bristles of the brush. The size, cross-sectional area, and length of the fingers 30 are selected so that there is sufficient resistance to movement of a brush that it will be held without falling out. Conversely, the cross-sectional area and length of the fingers 30 must be limited so that insertion of a brush is relatively easy and that the fingers 30 do not damage the bristles of a brush when a brush is pulled through the brush holder 10.

In the illustrated embodiment, the length of the projections or fingers 30 are about 35% of the height of the sidewalls 22. The fingers 30 are stepped cylindrical shapes having a relatively larger diameter base 31 and a relatively smaller diameter extension 32, the diameter of the base 31 being between 1.5 and 2.0 times the diameter of the extension 32. In the preferred embodiment, 35% was found to be a useful height for the fingers 30 such that about 30% of the interior width of the brush holder 10 is open. With a different size, shape, or material the fingers 30 could range from about 10% at the height of the sidewalls 22 to about slightly more than 50% of the height of the sidewalls 22. The size and shape of the fingers 30 is preferably uniform, but the fingers 30 may be of differing sizes, shapes and dimensions without affecting the utility of the invention.

The two casing halves 20 are joined together by placing the sidewalls 22 of the casing halves 20 adjacent one another so that they are parallel and aligned vertically and along their length. The sidewalls 22 are then joined together by any suitable means such as mechanical fastening, for example, screws, staples or rivets 34, or by other means such as autogenous bonding achieved by the application of infrared, ultrasonic or radio frequency (RF) energy, or gluing with any suitable paint or solvent impervious adhesive. In the preferred embodiment of the invention, the planar walls 21, and the sidewalls 22 are solid and extend the entire length of the brush holder 10 but to facilitate liquid flow into and out of the brush holder 10, the sidewalls 22 may extend less than the full length of the brush holder 10 or may have openings disposed therein.

The casing halves 20 are constructed from polypropylene or other suitable material that has sufficient resiliency to deform when a paint brush is inserted into the brush holder 10 and exhibits resistance to paint and paint solvents. In general, this material will be a solvent resistant polymer but other materials may be used.

Figure 5:
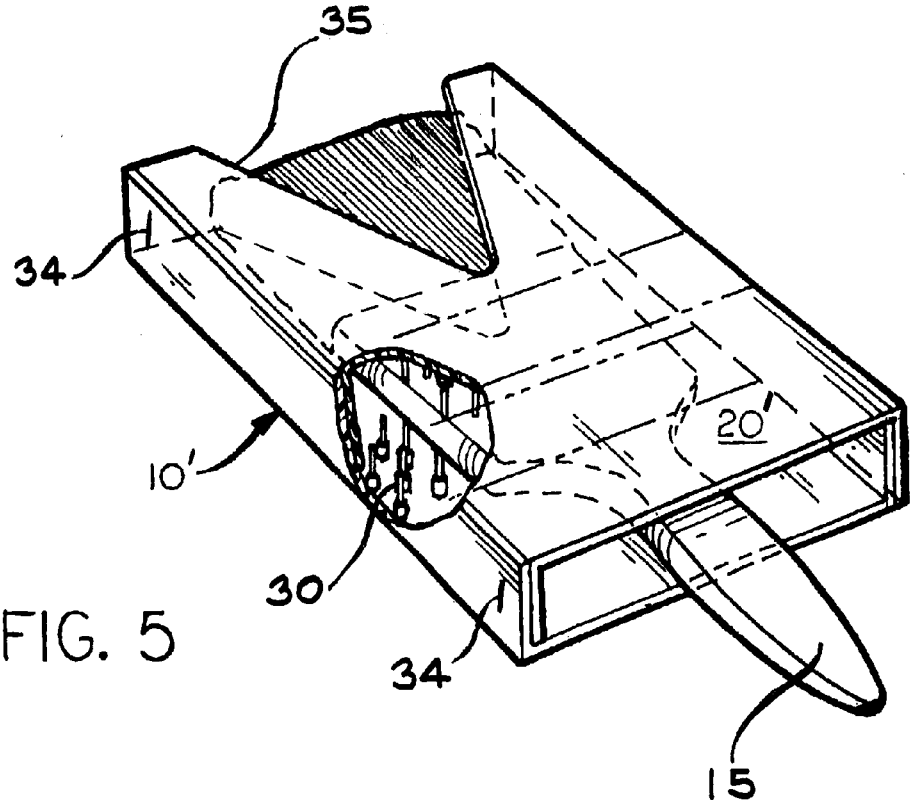
FIG. 5 is a perspective view with a portion broken away of a first alternate embodiment of a brush holder according to the present invention having a tapering slot which facilitates brush insertion with a brush disposed therein.

As shown in FIG. 5, a first alternate embodiment of the brush holder 10' provides openings 35 in each casing half 20' that allow for the free movement of solvent or paint around the paint brush bristles, but retains sufficient strength to support the weight of the paint brush and prevent the paint brush bristles from contacting the container the paint brush is placed in. These openings 35 may take the form of a cut-out of varying or constant width, i.e., a triangular or rectangular opening, extending from the bottom of the paint brush holder 10', for a distance of 1 to 2 inches (2.5 to 5.1 cm.) to facilitate placing the paint brush 15 in the paint brush holder 10'. The paint brush 15 may then be conveniently gripped by the body during insertion until the handle of the paint brush 15 extends far enough out of the paint brush holder 10' that the handle may be used to complete insertion.

Figure 6:
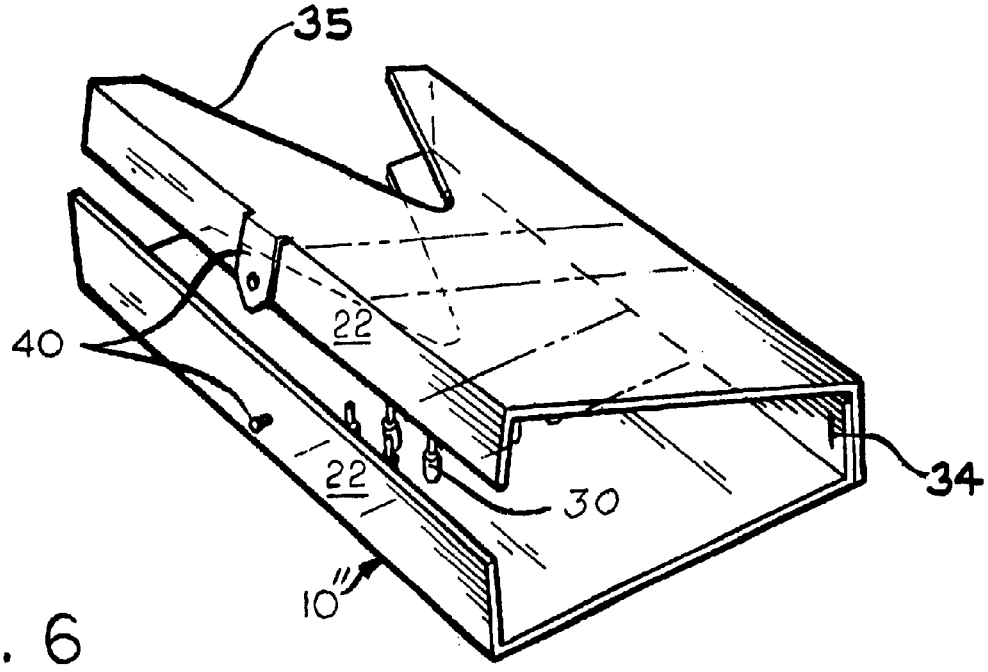
FIG. 6 is a perspective view of a second alternate embodiment of a brush holder according to the present invention having an integral structure for selectively securing the halves of the holder.

In a second alternate embodiment 10", the brush holder 10" is constructed from essentially similar casing halves 20, but rather than being permanently fixed along the length of both sidewalls 22, only one set of the sidewalls 22 is permanently affixed to each other. Referring to FIG. 6, on the other set of the sidewalls 22, interengaging structures 40 for fastening the sidewalls 22 together are provided, such as a snap, latch, tab and complementary restraining slot, or a releasable hook and loop fastener such as Velcro® fasteners. The interengaging structures 40 may be integrally molded into the sidewalls 22 or may be added after the sidewalls 22 are formed. The flexibility of the material of the brush holder 10" and particularly reduced thickness portions defining the line intersections of the planar wall 21 with the adjacent sidewalls 22 which function as live hinges allows the brush holder 10" to be opened for insertion and removal of a brush 15, negating the need to supply actual hinges on the pair of sidewalls 22 that are permanently adhered to each other.

The foregoing disclosure is the best mode devised by the inventors for practicing this invention. It is apparent, however, that apparatus incorporating modifications and variations will be obvious to one skilled in the art of brush storage. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

We claim:

1. A device for holding a brush comprising, in combination, a first casing half, a second casing half, said first and second casing halves each including a generally rectangular planar wall having an interior surface and an exterior surface, a first pair of sidewalls extending from said planar wall of said first casing half, a second pair of sidewalls extending from said planar wall of said second casing half, each of said first pair of sidewalls secured to a respective one of said second pair of sidewalls and said walls and said sidewalls defining substantially equal end openings, and a plurality of flexible fingers extending from said interior surfaces of said casing halves, wherein each of said plurality of flexible fingers is stepped to define a first region having a first diameter and a second region having a second diameter smaller than said first diameter.

2. The device of claim 1 wherein at least one said flexible finger extending from said interior surface of said first casing half substantially aligns with at least one said flexible finger extending from said interior surface of said second casing half.

3. The device of claim 1 further including cut-outs in said sidewalls.

4. The device of claim 1 wherein said pairs of sidewalls are secured together by mechanical fasteners.

5. The device of claim 1 wherein said pairs of sidewalls are secured together by staples.

6. The device of claim 1 wherein said pairs of sidewalls are secured together by autogenous bonding.

7. A device for holding a brush comprising, in combination, a first casing half, a second casing half, said first and said second casing halves each including a planar wall having an interior surface and an exterior surface, a first pair of sidewalls extending from said planar wall of said first casing half, a second pair of sidewalls extending from said planar wall of said second casing half, one of said first pair of sidewalls secured to one of said second pair of sidewalls, an interengaging fastener having a first portion disposed on the other one of said first pair of sidewalls and a second portion disposed on the other one of said second pair of sidewalls, and a plurality of flexible projections on said interior surfaces of said casing halves, each of said plurality of flexible projections being stepped to define a first region having a first diameter and a second region having a second diameter smaller than said first diameter.

8. The device of claim 7 wherein at least one said flexible projection on said interior surface of said first casing half substantially aligns with at least one said flexible projection on said interior surface of said second casing half.

9. The device of claim 7 further including cut-outs in said sidewalls.

10. The device of claim 7 wherein said one of said pair of sidewalls and said one of said second pair of sidewalls are secured together by mechanical fasteners.

11. The device of claim 7 wherein said one of said first pair of sidewalls and said one of said second pair of sidewalls are secured together by staples.

12. The device of claim 7 wherein said one of said first pair of sidewalls and said one of said second pair of sidewalls are secured together by autogenous bonding.

13. A device for holding a brush comprising, in combination, a first casing half, a second casing half, said first and second casing halves each including a planar wall having an interior surface and an exterior surface, a first pair of sidewalls extending from said planar wall of said first casing half, a second pair of sidewalls extending from said planar wall of said second casing half, each one of said first pair of sidewalls secured to a respective one of said second pair of sidewalls and said walls and said sidewalls defining substantially equal end openings, and a plurality of projections extending from said interior surfaces of said casing halves, each of said projections defining a first region having a first diameter and a second region having a second diameter smaller than said first diameter.

* * * * *